United States Patent [19]

Wells, III et al.

[11] Patent Number: 4,459,154

[45] Date of Patent: Jul. 10, 1984

[54] ALLOY AND PROCESS FOR PRODUCING AND CASTING DUCTILE AND COMPACTED GRAPHITE CAST IRONS

[75] Inventors: James E. Wells, III, Kenmore; Henry F. Linebarger, Tonawanda; Thomas K. McCluhan, N. Tonawanda, all of N.Y.

[73] Assignee: Elkem Metals Company, Pittsburgh, Pa.

[21] Appl. No.: 418,237

[22] Filed: Sep. 15, 1982

[51] Int. Cl.[3] ..... C22C 33/08

[52] U.S. Cl. ..... 75/130 R; 75/53; 75/123 R; 75/123 K; 75/123 L

[58] Field of Search ..... 75/130 R, 129, 53, 123 R, 75/123 K, 123 L, 123 E

[56] References Cited

U.S. PATENT DOCUMENTS

| | | | |
|---|---|---|---|
| 3,421,887 | 1/1969 | Kusaku | 75/130 R |
| 4,147,533 | 4/1979 | Flinn | 75/130 R |
| 4,246,026 | 1/1981 | Stefanescu | 75/130 R |

OTHER PUBLICATIONS

Trojan & Flinn, "A New Method for Determination of Liquid-Liquid Equilibrium as Applied to One F-C-Si--Mg System", T. Am. Soc. Metals, vol. 54, No. 3 (1961).

Guichelaar et al., "A New Technique for Vapor Pressure Measurement Applied to the Fe-Si-Mg System", Metallurgical Trans., vol. 2, No. 12, pp. 3305-3313 (12/1971).

Guichelaar, "Equilibrium Immiscibility Relations in the Fe-Mg-Si Ternary Liquid System", (U. Mich. Ph.D. dissert. 1969).

Trojan, "Liquid-Liquid Equilibria & Thermodynamic Data for the Fe-C-Si-Mg System", (U. Mich. 1961).

Clark & McCluhan, "Influence of Mg Content on the Nodularizing Efficiency of Mg-FeSi Alloys", Trans. Am. Foundrymens Soc., pp. 442-445, vol. 73 (1965).

Trojan and Flinn, "Fundamentals of Mg Addition to Ductile Iron", Trans. of the Society of Automotive Engineers, vol. 73 (1965).

*Primary Examiner*—Peter D. Rosenberg

*Attorney, Agent, or Firm*—Eyre, Mann, Lucas & Just

[57] ABSTRACT

This invention relates to a new and unique alloy composition and to the method of treating molten cast iron with such alloy to produce ductile and compacted graphite cast irons. The alloy is a predominately iron alloy having the essential elements by weight of from about 0.1 to about 10% silicon, from about 0.5 to about 4.0% magnesium, from about 0.1 to about 10.0% nickel and optionally from about 0.1 to about 2.0% cerium, and/or other rare earth elements. The alloy may comprise from about 0.1 to about 10.0% silicon, from about 0.5 to about 4.0% magnesium, from about 0.1 to about 10.0% nickel, optionally from about 0.1 to about 2.0% cerium and/or other rare earth elements, from about 0.5 to about 6.5% carbon and the balance iron. Small amounts of calcium, barium or stronium and trace elements customarily found in conventional raw materials used in producing the alloy may also be present. The characteristics of the alloy make it possible to establish a ready supply of treated molten iron in the foundry in holding vessels with a selected chemical composition at a given temperature. It also makes possible semicontinuous and continuous casting of ductile and compacted graphite cast irons.

46 Claims, 7 Drawing Figures

ALLOY AND PROCESS FOR PRODUCING AND CASTING DUCTILE AND COMPACTED GRAPHITE CAST IRONS

This invention relates to an alloy of exceptional utility for producing ductile cast iron or compacted graphite cast irons and to the process of treating cast iron with said alloy. The alloy comprises a low silicon, low magnesium, low nickel and optionally cerium and/or other rare earth elements as the essential elements in a predominately iron alloy. For best results, the density of the alloy approaches and at least equals and preferably exceeds the density of the molten iron to be treated.

It is known to introduce magnesium in controlled quantities into a melt of ordinary gray cast iron in order to cause the carbon to solidify in a spheroidal form and thereby produce ductile cast iron with greatly improved tensile strength and ductility over that exhibited by ordinary cast iron. The amount of magnesium retained in the cast iron for this purpose is generally from about 0.02 to about 0.08% by weight of iron.

Compacted graphite cast iron, also known as vermicular graphite iron, is also produced by addition of magnesium. The amount of magnesium retained in cast iron for this purpose is much less and of the order of about 0.015% to about 0.035% based on the weight of iron. In the case of compacted graphite cast iron, the magnesium causes the carbon in the cast iron to become more chunky and stubby but short of going over to the complete spheroidal form of ductile cast iron. Compacted graphite cast iron has improved tensile strength compared to gray cast iron and may possess greater resistance to thermal shock and greater thermal conductivity than ductile cast iron.

The commercial production of ductile and compacted graphite cast irons is well-known and as is known, difficulties are encountered by virtue of the pyrotechnics that occur when magnesium is added to molten cast iron. The molten iron bath fumes, smokes and flares with resulting uneconomical loss of magnesium, air pollution and difficulty in controlling the addition of measured amounts of magnesium to the molten iron for the desired result. Typically in the existing processes with conventional treating materials such as elemental magnesium and magnesium alloys, there may be less than 50% by weight of supplied magnesium recovered in the molten iron.

Conventional ferrosilicon alloys containing 5% or more magnesium by weight allow for somewhat higher magnesium recoveries, and may approach 50%, than processes in which elemental magnesium is used. However, among other things these have the drawback of a high silicon content which reduces flexibility in the foundry with respect to using scrap since the silicon content in the final product must be maintained at a known acceptable level to avoid impairing the impact characteristics of the final product. Magnesium-ferrosilicon alloys of high silicon content have a tendency to float on the surface of a molten iron bath which further contributes to the loss of magnesium (see U.S. Pat. Nos. 3,177,071; 3,367,771; and 3,375,104).

Magnesium-nickel alloys have also been used but the exceptionally high nickel content in the alloy restricts the use to those special, limited cases where a high nickel cast iron is desired. Otherwise, the cost of nickel in the alloy makes it too expensive for general use in producing ordinary ductile and compacted graphite cast irons (see U.S. Pat. Nos. 3,030,205; 3,544,312). The use of coke and charcoal briquettes impregnated with magnesium (U.S. Pat. Nos. 3,290,142; 4,309,216) has been suggested as well as compacted particulate metals (U.K. Pat. Nos. 1,397,600; 2,066,297). While these may assist somewhat in reducing the loss of magnesium, special processing techniques are required for producing the specified structures and special handling techniques are required in the foundry.

Mechanical approaches have also been suggested wherein a magnesium composition is introduced or positioned below the surface of the molten iron bath (U.S. Pat. Nos. 2,896,857; 3,080,228; 3,157,492; 3,285,739; 4,147,533; 4,166,738; and 4,261,740). While these mechanical approaches tend somewhat to inhibit pyrotechnics caused by the violent reaction of magnesium, substantial quantities of magnesium vapor still escape into the atmosphere and the added steps incident to a mechanical approach do not adequately compensate for the loss.

Another drawback to prior art processes involves use of a single batch operation wherein the quantity of magnesium required for converting ordinary cast iron to ductile or compacted graphite iron is usually introduced in a single addition below the surface of the molten iron in a foundry ladle. The magnesium alloy may be held in a plunging bell that is immersed below the surface of the molten iron or the alloy may be placed in the bottom of the ladle and covered with scrap in a sandwich technique or positioned in a submerged reaction chamber positioned in the gating system of a mold. Some form of constraint is customarily used to prevent the high silicon-iron-magnesium alloy from floating on the surface of the molten bath.

Periodic additions of conventional alloys having a high level of silicon to a bath of molten cast iron are not practical in existing foundry practices. Such alloys carry in substantial quantities of silicon with resulting increase in silicon concentration which soon exceeds the acceptable level in the ductile or compacted graphite irons.

In accordance with the present invention, the molten cast iron to be treated with magnesium may be held in a furnace or foundry ladle while the alloy is periodically added to the molten iron over an extended period of time as compared to conventional foundry practices. The alloy may be judiciously added periodically in predetermined amounts to establish and maintain the desired chemical composition of the melt at a given temperature. The periodic addition of the alloy can also be timed to make-up for such magnesium that may be vaporized from the melt during the holding period of time. If desired the melt may be desulfurized which is of advantage in those cases where the molten cast iron has a relatively high sulfur content which may inhibit nodulation or compaction of the carbon. When treated metal is tapped from a molten bath, an additional quantity of molten cast iron to be treated with magnesium may be added to the bath to provide a semi-continuous process or the magnesium-nickel-silicon-iron alloy may be added to a flowing stream of molten cast iron to establish a continuous treatment process. Another advantage of the process of the invention is that it provides a ready supply of molten ductile or compacted graphite cast irons and it reduces the handling of materials in the foundry.

These advantages are made possible by using an alloy which is predominately iron and has a low silicon, low magnesium and low nickel content as the essential elements thereof. When this alloy is added to molten cast iron, the smoke, fumes or flaring is reduced as compared to the conventional magnesium or some of the magnesium-nickel alloys. The recovery of magnesium in the molten cast iron is at least equal to conventional alloys and may range up to about 60% percent by weight and more of the available magnesium in the alloy added to the melt. There is no significant fluctuation in the silicon content of the treated molten iron caused by addition of the alloy. Since the alloy may be periodically added to the holding vessel, desulfurizing action and treatment to produce ductile and compacted graphite cast irons may be combined in a single vessel in a single operation.

The alloy of the present invention contains as essential elements from about 0.1 to about 10.0% silicon, from about 0.5 to about 4.0% magnesium, from about 0.1 to about 10.0% nickel and the balance is iron. From about 0.1% to about 2.0% cerium and/or other rare earth elements is optionally present and carbon in the amount from about 0.5 to about 6.5% will usually be present as well as small amounts of other elements such as calcium (0 to 0.05%) barium, or strontium and trace elements conventionally present in the raw materials used in producing the alloy. All percentages are based on the weight of the alloy.

The very low amount of silicon in the alloy is of particular advantage in that scrap metals of relatively high silicon content may be used in the cast iron melt, and still provide a final product with a commercially acceptable level of silicon. Excess silicon in the final ductile or compacted graphite cast iron tends to give the iron low impact characteristics which are undesirable in some applications. The high concentration of iron in the alloy of the present invention is of further advantage for increasing the density of the alloy which reduces the tendency to float with a concurrent reduction in pyrotechnics and increased recovery of magnesium in the molten iron. Conventional magnesium alloys containing twenty-five and more percent by weight of silicon have a density of about 3.5 to about 4.5 gms/cm$^3$ which does not provide the advantages and flexibility of the low silicon alloy of the present invention. In general, molten cast iron has a density of about 6.0 to 6.5 gms/cm$^3$ whereas the alloy of the present invention may have a density from about 6.5 gms/cm$^3$ to about 7.5 gms/cm$^3$ achieved by selecting the proper proportion of ingredients within the specified ranges in known manner for the selected alloy density.

For example, an alloy of the present invention containing from about 0.9 to about 2.0% magnesium, from about 3.0 to about 6.0% carbon, from about 3.0 to about 6.0% silicon and up to about 0.6% nickel and optionally from about 0.1 to about 2.0% cerium and/or other rare earth elements (all in percent by weight) and balance of iron will have a density of about 7.0±0.5 gms/cm$^3$.

Best results are achieved when the density of the alloy of the present invention approaches and preferably exceeds the density of the molten iron to be treated. In such case the alloy does not tend to float and it may be readily circulated through the melt by gentle agitation.

The low magnesium content of the alloy of this invention materially contributes to a high recovery of magnesium in the treated molten cast iron accompanied by a highly desirable reduction in pyrotechnics. The high and relatively consistent recoveries resulting from the low magnesium content of the alloy also facilitate control of the amount of magnesium retained in the melt which assists in providing the proper amount of magnesium within the narrow range required to produce compacted graphite cast iron.

Nickel is important since it assists in achieving a high recovery of magnesium in the molten cast iron and the low nickel content of the alloy keeps the input of nickel in the ductile and compacted graphite cast irons at acceptable levels. The nickel is also of advantage in preparing the alloy in that it provides a high level of recovery of magnesium in the alloy.

The cerium and/or other rare earth element content of the alloy counteracts the deleterious effect of tramp elements such as lead, bismuth, titanium and antimony which tend to inhibit nodulization of graphite that precipitates from the melt for production of ductile cast iron. The cerium and/or other rare earth elements also have nucleating and nodulizing effects in the melt and a tendency to reduce the formation of undesirable carbides in ductile cast iron. Cerium is the preferred rare earth element.

The alloy of the present invention may be made in conventional manner with conventional materials known in the art. In a preferred procedure the vessel in which the alloy is formed is held under a pressure of an inert gas such as argon at about 50 to 75 p.s.i.g. Conventionally available magnesium scrap, magnesium silicide or magnesium metal may be used in producing the alloy. The rare earth elements may be introduced as elements per se into the alloy, or mischmetal may be employed, or cerium metal or cerium or rare earth silicides may be used. Silicon metal, ferrosilicon, silicon carbide and ordinary pig iron or steel scrap may be used in producing the alloy. Nickel scrap, nickel metal per se or nickel bearing alloys may be used in producing the alloy of the present invention. The amounts of raw materials are controlled in known manner to form an alloy within the specified range of elements. Best results are achieved by rapid solidification of the alloy melt.

One preferred form of apparatus and process for producing the alloy of the present invention is described in a copending application Ser. No. 418,238 filed Sept. 15, 1982. As described in more detail in the copending application, the contents of which are hereby incorporated by reference into this application, the alloys of the present invention may be produced in a tilting induction furnace having a graphite receiver mounted in a sealed and horizontal position on top of the induction furnace enclosed inside an outer pressure vessel. After the alloy melt is formed, the induction furnace is rotated to pour the melt into the receiver which has thereby been rotated to pour the melt into the receiver which has thereby been rotated into a vertical position. While the apparatus and process described in the copending application is of great advantage in producing the alloy of this invention, it need not be used and conventional apparatus may be employed.

For example, the alloys of the present invention may be produced in conventional apparatus by charging the following ingredients into a suitable vessel where the ingredients were heated to 1350° C. while held under argon gas pressure of 75 p.s.i.g. for three minutes. Thereupon, the melt was rapidly solidified by pouring into a cylindrical graphite chill mold dish 8 inches in diameter.

TABLE I

| ALLOY | Iron | Charge in Grams Nickel | Cerium | Magnesium |
|---|---|---|---|---|
| 2314-76 | 3000* | 61 (Nickel Shot) | 7 (Cerium Silicide)** | 77 |
| 2314-57 | 3000* | 30 (Nickel Shot) | 6 (Cerium Silicide)** | 75 |
| 2314-54 | 3000* | 15 (Nickel Shot) | 6 (Cerium Silicide)** | 75 |

*The iron charged in alloy 2314-76 contained 3.89% carbon and 4.49% silicon. The iron charged in alloys 2314-57 and 54 contained 3.95% carbon, 4.41% silicon and 0.084% cerium.
**The cerium silicide charged in all cases contained 25% cerium, 35% silicon and 35% iron and a total of 27% rare earth elements.

The alloy ingot was produced in the chill mold with the following composition:

TABLE II

| Alloy | Ingot Grams | Elemental % by Weight Carbon | Silicon | Magnesium | Nickel | Cerium | Iron |
|---|---|---|---|---|---|---|---|
| 2314-76 | 3046 | 4.05 | 4.38 | 2.00 | 2.26 | 0.13 | balance |
| 2314-57 | 3086 | 3.71 | 4.47 | 1.64 | 0.89 | 0.14 | balance |
| 2314-54 | 3005 | 3.58 | 4.39 | 1.49 | 0.47 | 0.11 | balance |

The alloy exhibited an exceptionally high recovery of magnesium in the charge. In alloy 2314-76, the magnesium recovery was 79% by weight, 67% by weight of magnesium was recovered in alloy 2314-57 and 60% by weignt of the magnesium charge was recovered in alloy 2314-54.

As a result of rapid solidification, the magnesium in the alloy of the present invention is retained as a fine dispersion or separate phase within the iron-carbon-silicon matrix. Since the magnesium exists as a fine dispersion in the alloy, the interaction between the magnesium and the molten cast iron being treated in the foundry takes place at a multitude of locations. The advantage of such dissolution of magnesium in the foundry melt is that a higher recovery of magnesium in the treated cast iron is achieved as compared to conventional magnesium ferrosilicon alloys.

Additional examples of predominately iron alloys of the present invention using the above-described procedure and a charge containing appropriate amounts of raw materials to yield alloys having the following chemical analysis of elements in percent by weight are given in Table III which follows:

TABLE III

| Alloy Heat | Ingot Weight Kg | Carbon | Silicon | Magnesium | Nickel | Cerium | Iron |
|---|---|---|---|---|---|---|---|
| 108 | 6.56 | 3.34 | 4.45 | 1.04 | 0.48 | 0.13 | balance |
| 98 | 6.47 | 3.07 | 4.33 | 1.46 | 0.50 | 0.12 | balance |
| 99 | 6.47 | 3.44 | 4.39 | 1.17 | 0.51 | 0.14 | balance |
| 100 | 6.39 | 3.38 | 4.50 | 1.50 | 0.51 | 0.13 | balance |
| 93 | 6.39 | 3.12 | 4.35 | 1.08 | 0.47 | 0.13 | balance |
| 96 | 6.24 | 2.83 | 4.36 | 1.07 | 0.48 | 0.14 | balance |
| 97 | 6.00 | 3.05 | 4.52 | 1.23 | 0.49 | 0.16 | balance |
| 110 | 3.10 | 3.36 | 4.45 | 1.34 | 0.49 | 0.16 | balance |
| 111 | 3.09 | 3.22 | 4.46 | 1.37 | 0.47 | 0.15 | balance |
| 112 | 2.99 | 3.35 | 4.56 | 1.34 | 0.47 | 0.13 | balance |
| 125 | 2.89 | 3.57 | 4.72 | 1.42 | 0.52 | 0.16 | balance |
| 124 | 2.88 | 3.25 | 4.75 | 1.46 | 0.50 | 0.14 | balance |
| 117 | 2.78 | 3.43 | 4.54 | 1.34 | 0.44 | 0.11 | balance |
| 109 | 2.66 | 3.58 | 4.67 | 1.61 | 0.48 | 0.16 | balance |

Any desired procedure may be used in treating molten cast iron with the alloy of the present invention to produce ductile or compacted graphite cast irons such as the known sandwich method, pour-over technique, positioning the alloy within a reaction chamber inside a mold, adding the alloy to a stream of molten cast iron or to a bath of molten cast iron in a furnace or foundry ladle. The alloy may be introduced into the molten cast iron to be treated in molten form under pressure or in solid particulate form or as bars or ingots and the like depending on the foundry process at hand. The amount of alloy added to the cast iron to be treated may be varied in known manner depending on the selected oomposition for the final product. In general the amount of alloy added to molten cast iron is sufficient to retain from about 0.015 to 0.035% magnesium by weight of the treated iron to produce compacted graphite cast irons and from about 0.02% to about 0.08% by weight for ductile iron with nodular carbon. The exact level of magnesium in the treated molten iron may be determined by conventional foundry analysis. Because of the high magnesium recovery obtained by the alloy of the present invention in the treated metal, a smaller amount of the magnesium may be added to achieve the selected composition for the final product as compared to the customary alloys conventionally used. As is conventional in the art, the treated molten cast iron may be inoculated with a ferrosilicon composition to reduce the formation of iron carbides (U.S. Pat. No. 4,224,064).

For example, about 3200 pounds (±200 pounds) of typical foundry molten cast iron (3.81% carbon, 2.24% silicon and 0.03% sulfur) was treated with about 178 pounds (±1.0 pound) of the alloy of the present invention which contained 1.35% magnesium, 0.13% cerium, 0.52% nickel, 4.57% silicon and 3.26% carbon by the conventional sandwich technique.

The alloy was placed in the bottom of a foundry ladle and covered with about 67 pounds of steel and 15 pounds of cast iron borings. The molten cast iron at a temperature of about 2750° F. was poured into the ladle in about 26 seconds.

A sample of the treated molten cast iron was taken from the melt one minute after the pour was complete. The sample was analyzed and contained 0.035% magnesium, 3.77% carbon, 2.27% silicon and 0.024% sulfur. The recovery of magnesium in the treated cast iron was about 51%. Another sample taken about eleven minutes after the pour was completed contained 0.052% magnesium, 3.77% carbon and 2.63% silicon.

Under quantitive metallographic analysis, there were 162 carbon nodules per $mm^2$ and 90% of the carbon was nodulized in a speciman casting. This example demonstrates that the alloy is an effective nodulizer. In the specification and claims all percentages are by weight unless indicated to the contrary.

Molten cast iron was treated with alloys of the present invention having the following compositions:

TABLE IV

| Run | Cerium | Elemental % by Weight Nickel | Magnesium | Carbon | Silicon | Iron |
|---|---|---|---|---|---|---|
| 1 | 0.0 | 0.50 | 1.54 | 3.95 | 3.78 | balance |
| 2 | 0.17 | 0.61 | 1.57 | 3.95 | 4.17 | balance |

In these examples, the molten iron to be treated contained 3.7% carbon, 1.70% silicon, 0.014% sulfur and 0.72% manganese with the balance being iron and the usual trace elements. The preweighed nodulizing alloy calculated to provide a 0.06% magnesium addition to seven kilograms of the base iron was placed on the bottom of a preheated (1100° C.)clay-graphite crucible.

Seven kilograms of the base iron at 1525° C. was rapidly poured over the alloy from a transfer ladle. When the temperature of the treated molten iron dropped to 1350° C., it was post inoculated by addition of 0.5% silicon as contained in foundry grade 75% FeSi mechanically stirred into the bath. After complete dissolution of the post inoculant samples were taken and analyzed as follows:

TABLE V

| Run | % Carbon | % Silicon | % Magnesium | % Magnesium Recovered |
|---|---|---|---|---|
| 1 | 3.58 | 2.31 | 0.039 | 65 |
| 2 | — | 2.19 | 0.036 | 60 |

At a temperature of 1325° C. the bath of treated molten iron was slagged and specimen castings with fins having 0.6 cm and 1.0 cm thickness were poured for each run. The fins were cut from the specimens, polished and subjected to a quantitive metallographic analysis for carbon nodularity percent and nodule count per unit of area.

TABLE VI

| Run | % Nodularity 0.6 cm/1.0 cm | Nodules/mm$^2$ 0.6 cm/1.0 cm |
|---|---|---|
| 1 | 78/82 | 206/195 |
| 2 | 84/84 | 254/258 |

As shown in the examples, the alloys of the present invention provide a high recovery of magnesium in the treated molten cast iron with nodularity within the range of from about 75 to about 90% which demonstrates their effectiveness as a nodulizing reagent. The low amount of silicon added by the alloy is of advantage for treating molten cast iron since it provides flexibility and procedures not heretofore used in the foundry with conventional alloys.

Conventional foundry apparatus may be used in carrying out the processes of the present invention. Some preferred types of processes and apparatus for carrying out the processes are illustrated in the drawings in which.

Figure 1:
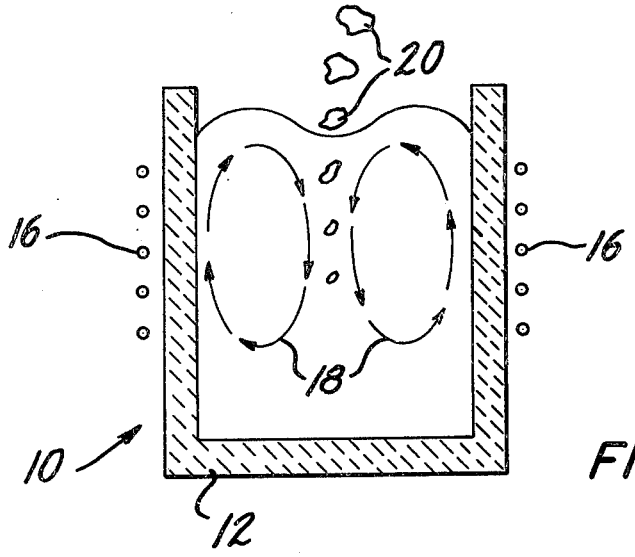
FIG. 1 illustrates a foundry ladle in section equipped with and electric induction stirring coil which may be used as a holding vessel.

Turning now to FIG. 1, the foundry ladle 10 is conventionally lined with a suitable refractory 12 which may be an alumina, silica, graphite or magnesia type refractory with or without an exterior metal casing. The exterior of the ladle is provided with a conventional electric induction stirring coil 16, preferably operated in known manner to cause the molten cast iron therein to circulate and flow from opposite sides of the bath so that the molten iron flows downwardly in the middle of the bath as illustrated by the arrows 18. Pieces 20 of alloy of the present invention of the composition specified hereinabove are slowly added manually or by means of a mechanical feeder (not shown). Circulation of the molten cast iron will pull the alloy underneath the surface of the bath for treating the molten iron to produce ductile or compacted graphite cast iron depending on the composition of the molten iron and input of magnesium from the magnesium-nickel-iron and optionally cerium and/or other rare earth elements alloy. Depending on the particular foundry operation, the treated cast iron may be held in the ladle over an extended period of time and the desired chemical composition of the molten cast iron may be established and maintained by periodically adding additional alloy as deemed necessary. A portion of the treated iron may be poured off and cast and fresh molten base iron may be added from the furnace to replenish the supply accompanied or followed by the addition of more alloy for the desired treatment. Ladle 10 may be gimbaled in known manner (not shown) and tilted for pouring by known foundry mechanical devices.

If desired, the ladle 10 may be equipped with conventional heating elements (not shown) to maintain the selected temperature for treatment and in place of the induction coil 16, the ladle may be provided with a conventional mechanical or pneumatic stirrer (not shown) for gentle agitation. Operation of the induction coil 16 may be changed in known manner to cause the metal in the bath to flow in opposite directions to arrows 18 and move upwardly in the middle of the bath and downwardly on opposite sides. In such case the pieces of alloy 20 are added at opposite sides of the ladle instead of in the middle as shown in the drawing.

Desulfurization of the molten cast iron may also be carried out in the holding ladle before and during treatment to produce ductile or compacted graphite cast irons. For example, if the molten cast iron contains sulfur on the order of 0.1% by weight this may be reduced in the holding ladle down to about 0.01% by weight or less by addition of alloy during the holding period of time.

The molten bath of cast iron in a furnace vessel (not shown) in which it is produced may also be used as a holding vessel and the alloy of the present invention may be added to the furnace bath to treat the molten cast iron as described above for ladle 10.

Holding ladle 10 may be provided with a cover (not shown) and the molten cast iron and alloy may be fed into the ladle through the cover. If desired for reduction of oxidation, a partial or complete atmosphere of an inert gas such as argon may be established in known manner in the space between the cover and surface of the bath. The ladle may be equipped with a bottom tap hole (not shown) for withdrawal of treated molten metal. The bottom tap hole may be opened and closed by a plug (not shown) operated in known manner by mechanical means.

While desirable results are achieved by using pieces of alloy from one to two inches in greatest dimension, the alloy may be more finely divided even down to a rough powder or the alloy may be melted and fed into the holding vessel in molten form with the bath under pressure of an inert gas to treat the molten cast iron. Rods, bars or ingots of the alloy may be used for treating the molten cast iron.

Figure 2:
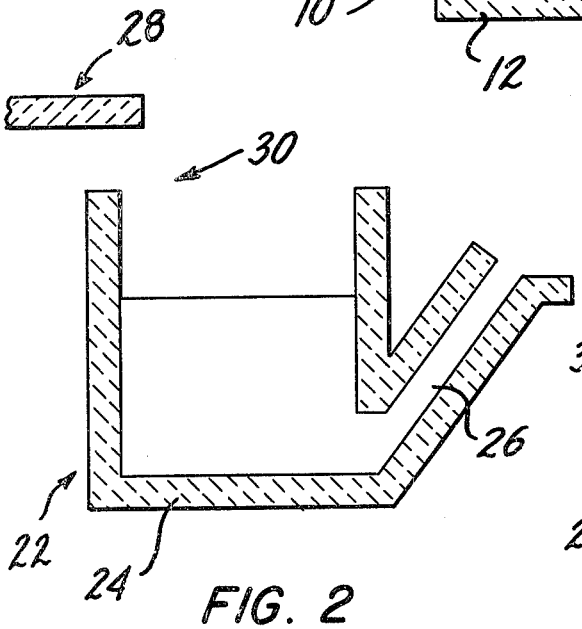
FIG. 2 illustrates another form of foundry ladle in section which may be used as a holding vessel in a batch or continuous operation.
Figure 3:
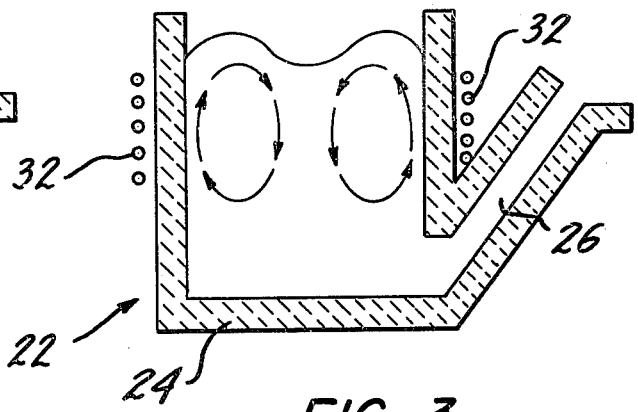
FIG. 3 illustrates the ladle of FIG. 2 equipped with an electric induction stirring coil.

The modified forms of ladle 10 shown in FIGS. 2 and 3 include a ladle 22 of usual refractory 24 lining with a tea-pot outlet spout 26 for pouring. In this case, a stream of molten cast iron from a melting source such as a cupola (not shown) is fed to the ladle at 28. The alloy of the present invention is supplied into the stream of molten cast iron at 30. The flow of the metal stream is used to carry the alloy beneath the surface of the bath where the alloy reacts with the molten cast iron and dissolves. FIG. 3 illustrates the ladle of FIG. 2 provided with an electric induction stirring coil 32 which may be used to assist in mixing the alloy and molten cast iron as previously described for the induction coil of FIG. 1. The induction coil may also be used to provide heat to the bath as desired for foundry operation.

Figure 4:
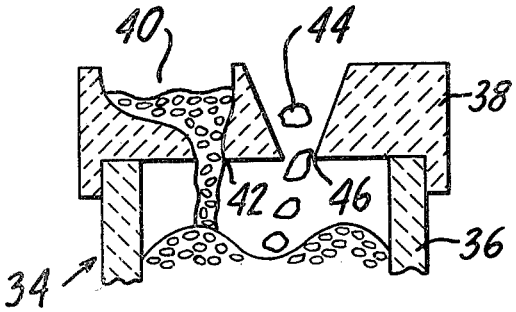
FIG. 4 illustrates a foundry ladle equipped with a cover modification.

The ladle 34 of FIG. 4 has the usual refractory 36 lining and is provided with a cover 38 having a reservoir 40 and inlet port 42 for supplying molten cast iron into the ladle. The alloy 44 of the present invention is manually or mechanically fed into the ladle through a separate inlet feed port 46. In this case the molten cast iron is fed at a controlled rate and the alloy is supplied at a controlled rate separated from the iron stream.

Figure 5:
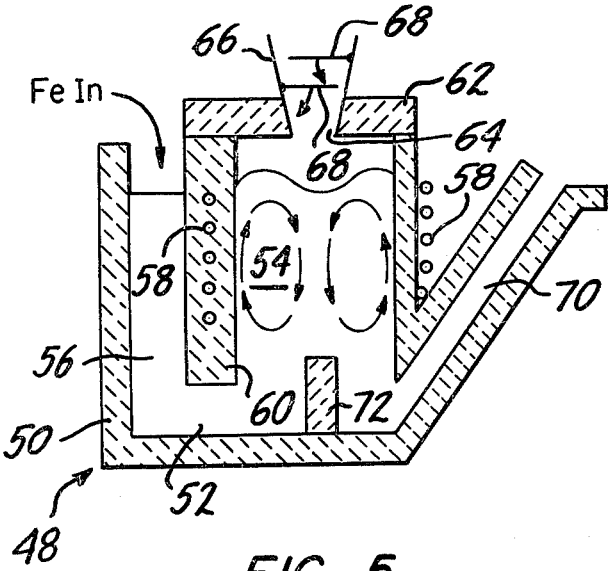
FIG. 5 illustrates a holding vessel with a modified form of cover.

Ladle 48 of FIG. 5 has the customary refractory 50 lining. An inlet port 52 for molten cast iron is positioned at one side of the bottom of the mixing chamber 54. The inlet port 52 is in open communication with an enclosed channel 56 that extends up to the top at one side of chamber 54. An electric induction coil 58 is positioned in the common wall 60 between channel 56 and chamber 54. The remainder of the coil is wrapped around the exterior of the wall of chamber 54. Mixing chamber 54 has a cover 62 with an inlet port 64 which is fitted with a hopper 66 having a plurality of staggered flop gate baffles 68 therein. The bottom of chamber 54 has a tea-pot pouring spout 70. A baffle 72 in the middle of the bottom of chamber 54 extends up above the top of inlet port 52 and above the top of exit to spout 70.

Molten cast iron is fed to mixing chamber 54 through channel 56 and the alloy of the present invention is supplied to the mixing chamber through the staggered flop gate baffles of hopper 66. Induction coil 58 mixes the molten metal and alloy as described in connection with FIG. 1. Periodically the treated metal is poured into casting molds as by tilting the unit in known manner. The baffle 72 prevents direct communication of molten cast iron between inlet port 52 and the exit of the tea-pot pouring spout 70. Make up molten cast iron may be added after each incremental pouring of treated iron and alloy is also added to maintain the selected chemical composition for treated iron. If desired, the top of spout 70 may be positioned further down below the top of chamber 54 and below the top of channel 56. In such case, molten metal will automatically pour out of the spout whenever the level of molten iron in chamber 54 and channel 56 is above the top of the spout.

Figure 6:
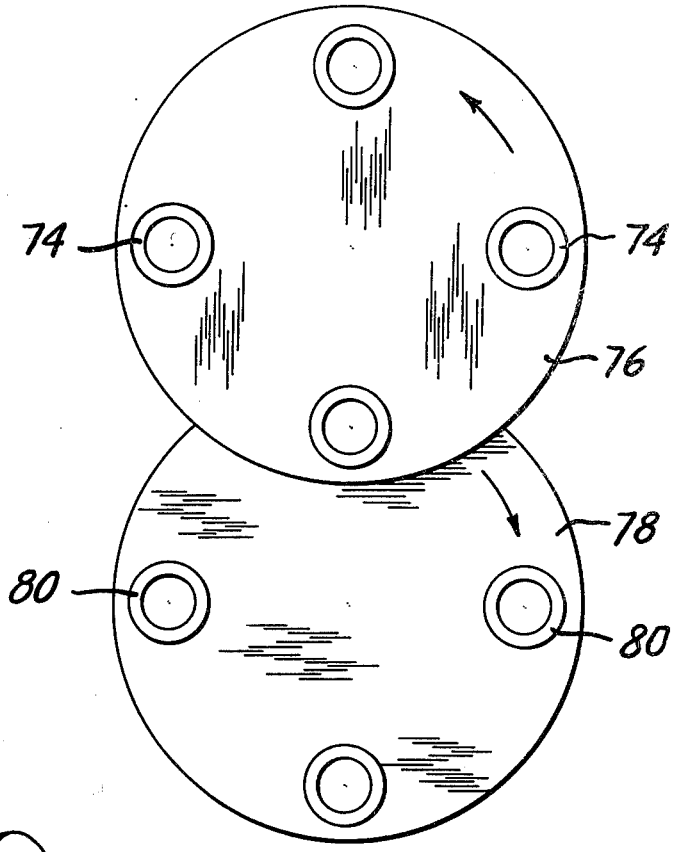
FIG. 6 illustrates one form of an automated pouring apparatus for mold casting.

FIG. 6 illustrates another method for the casting of treated molten cast iron. In this case a plurality of conventional foundry holding vessels 74 are carried in a rotating support 76 which is positioned above a second rotating support 78 that carries a plurality of casting molds 80. Suitable drive means (not shown) rotate the supports in separate circular paths in sequence to bring the casting molds into position below the holding vessels 74. The holding vessels have a tap hole in the bottom opened and closed by a plug actuated by mechanical means to pour molten treated iron into molds 80. If desired, the ladles may be gimbaled and tilted in known manner to pour the molten treated iron into the molds.

A furnace vessel (not shown) such as a cupola or a holding ladle containing a supply of molten iron containing carbon (ordinary cast iron) is positioned to pour the molten iron into the holding vessels 74. The alloy of the present invention which is predominately iron containing as essential ingredients a low silicon, low magnesium, low nickel and optionally cerium and/or other rare earth elements content as specified hereinabove is used to treat the molten iron in the holding vessels 74 and treatment of the iron with alloy is carried out as the holding vessels move toward their position to pour alloy treated molten iron into the casting molds.

Best results are achieved in this process by using the iron alloy of the present invention which has a density equal to and preferably greater than the density of the molten iron to be treated and which alloy contains from about 0.9 to 2.0% magnesium, 3.0 to 6.0% carbon, 3.0 to 6.0% silicon, 0.1 to 2.0% cerium and/or other rare earth elements and up to 0.6% nickel and balance iron.

In the preferred operation, the holding vessels 74 have a supply of treated molten iron adequate to fill a plurality of molds 80. In such case the pouring vessels are held stationary while a plurality of molds are moved one at a time into stationary position below a first one of the holding vessels. When the supply of treated molten iron in the first one of the holding vessels is low, the next holding vessel in line is moved into the stationary position to pour treated molten iron into the next plurality of molds. Meanwhile, the first one of the holding vessels receives a new supply of molten iron and alloy.

If desired, the supply of treated molten iron in each holding vessel may be limited to that required to fill a single casting mold. While the drawing illustrates moving the pouring vessels 74 and molds 80 in circular paths, the vessels and molds may move along any selected path other than circular with the selected paths arranged to intersect for transfer of treated molten iron from the vessels to the molds. In one example, the paths are oblong and treated molten metal is transferred into the molds while the pouring vessel and molds continue to move along a first straight intersecting portion of the oblong paths. In such case there is no need to hold the vessels and molds in stationary position for filling the mold. A resupply of metal to the holding vessels is obtained in similar manner while the vessels move along the second straight portion of their oblong path and a separate supply container moves along the same path above the vessels.

In the preferred operation untreated molten iron and alloy are supplied to the holding vessels in any desired sequence from selected sources of supply and reaction between the alloy and molten iron takes place before the vessel reaches its pouring position above the mold. If desired, alloy may be added to untreated molten iron in a furnace vessel or holding ladle to carry out the treatment reaction between the alloy and molten iron at the source of supply in the furnace vessel or holding ladle. The magnesium, nickel, optionally cerium treated molten iron is supplied to the holding vessels 74. Alloy can also be added to the treated iron in the holding vessel for final adjustment to obtain a selected chemical composition or the untreated molten iron may be partially treated at the source of supply in the furnace or holding ladle and treatment with alloy completed in the holding vessels 74.

In a modified process, rotating support 76 and holding vessels 74 are eliminated and the casting molds 80 are moved into stationary position below a furnace vessel or a holding ladle such as one of those illustrated in FIGS. 1 through 5. The molds are filled in sequence directly from the supply of treated metal in the furnace or holding ladle.

Figure 7:
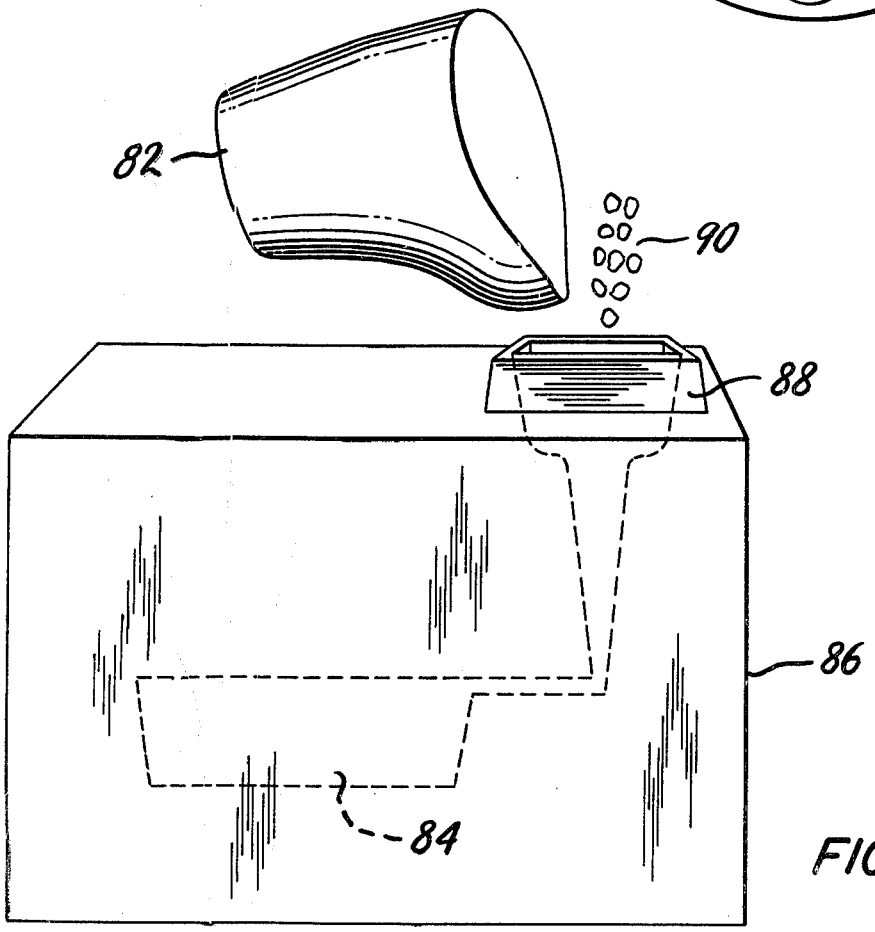
FIG. 7 illustrates one form of apparatus for introducing the alloy of the present invention into a flowing stream of molten cast iron in a continuous or batch operation.

In FIG. 7 a conventional refractory holding ladle 82 is employed for pouring molten iron into the cavity 84 of a casting mold 86. The pour of the mold has a small reservoir portion 88 which assists in receiving the molten cast iron. In this case, pieces of alloy 90 of the present invention are fed into the flowing stream of metal as it enters reservoir 88 and the flow of the stream carries the alloy down into the mold for treating the molten iron to produce ductile or compacted graphite cast iron depending on the input of magnesium into the molten cast iron.

It will now be understood that these processes are made possible by the essential characteristics of the alloy of the present invention comprising a predominately iron alloy with low silicon, low magnesium, low nickel and optionally cerium and/or other rare earth content and density which approaches the density and for best results is equal to or greater than the density of the molten cast iron to be treated. copending applications Ser. No. 362,866 and Ser. No. 362,867 filed Mar. 29, 1982 are directed to using alloys which do not include nickel for treating molten cast iron to produce ductile and compacted graphite irons.

It will also be understood that the preferred embodiments of the preferred form of the invention herein chosen for the purpose of illustration are intended to cover all changes and modifications which do not depart from the spirit and scope of the invention.

What is claimed is:

1. In the method of producing ductile or compacted graphite cast irons, the improvement which comprises the steps of holding molten iron that contains carbon in a vessel, adding to the molten iron bath an alloy predominately of iron which contains from about 3.0 to about 6.0% silicon by weight, from about 0.9 to about 2.0% magnesium by weight, and up to about 0.6% nickel by weight as the essential elements, continuing to hold said molten iron containing said alloy in said vessel until reaction between the magnesium and iron has taken place and thereafter in a second step adding more of said alloy to said molten iron to establish the desired chemical composition thereof.

2. The method of claim 1 wherein the alloy has a density greater than that of the molten iron.

3. The method of claim 1 wherein the alloy has a density between about 6.5 to about 7.5 gms/cm$^3$.

4. The method of claim 1 wherein the alloy predominately of iron also contains cerium in an amount not over about 2.0% by weight.

5. The method of claim 1 wherein the alloy predominately of iron also contains one or more rare earth elements in an amount not over about 2.0% by weight.

6. The method of claim 1 wherein the alloy predominately of iron contains by weight from about 0.1% to about 10.0% silicon, about 0.1 to about 2.0% rare earth elements, about 0.5 to about 4.0% magnesium, from about 0.1 to about 10.0% nickel and about 0.5 to about 6.5% carbon.

7. The method of claim 1 wherein the alloy comprises by weight from about 3.0 to about 6.0% silicon, up to about 2.0% cerium, about 0.9 to about 2.0% magnesium and up to about 0.6% nickel with the balance being iron.

8. The method of claim 1 wherein the holding vessel is the vessel of a furnace.

9. In the method of producing ductile or compacted graphite cast irons, the improvement which comprises the steps of holding molten iron that contains carbon in a vessel, treating said molten iron by adding to the molten iron bath a predominately iron alloy which as essential elements contains from about 0.1 to about 10.0% silicon by weight, from about 0.5 to about 4.0% magnesium by weight, and from about 0.1 to about 10.0% nickel by weight continuing to hold said molten iron in said vessel until the magnesium from said alloy has increased the magnesium content of said treated molten iron and thereafter adding more untreated molten iron that contains carbon to said vessel along with more of said alloy to increase the magnesium content of said untreated added iron.

10. In the method of producing ductile or compacted graphite cast irons, the improvement which comprises the steps of holding molten iron that contains carbon in a vessel, adding to the molten iron bath an alloy predominately of iron which contains as essential elements thereof from about 0.1 to about 10.0% silicon by weight, from about 0.5 to about 4.0% magnesium by weight, and from about 0.1 to about 10.0% nickel by weight reacting the magnesium and nickel of said alloy with said molten iron to increase the magnesium content of the molten iron to a selected level, continuing to hold said treated molten iron in said vessel until the magnesium content in said treated molten iron falls below the selected level and then adding more of said alloy to said molten iron to increase the magnesium content thereof at least to a selected level.

11. In the method of producing ductile or compacted graphite irons, the improvement which comprises the steps of holding molten iron that contains carbon and sulfur in a vessel, treating the molten iron by adding to the molten iron bath an alloy predominately of iron which contains as essential elements thereof from about 0.1 to about 10.0% silicon by weight, from about 0.9 to about 2.0% magnesium by weight and up to about 0.6% nickel by weight, continuing to hold said treated molten iron in said vessel until the sulfur content in the treated iron is reduced and thereafter adding more of said alloy to the molten iron to increase the magnesium content thereof.

12. In the method of producing ductile or compacted graphite cast irons, the improvement which comprises the steps of holding molten iron that contains carbon in a vessel, agitating the molten iron to establish circulation in a downward flow in the middle of the bath, adding to the surface of the middle of the bath a predominately iron alloy which contains as essential ingredients thereof from about 0.1 to 10.0% silicon by weight, from about 0.5 to 4.0% magnesium by weight and from about 0.1 to about 10.0% nickel by weight whereby the alloy is carried below the surface of the bath by the downward flow of molten iron.

13. The method of claim 12 wherein an electric induction stirring coil provides said agitation of the molten iron.

14. The method of claim 12 wherein the molten iron is agitated to flow upwardly in the middle of the bath and downwardly on opposite sides of the bath and wherein said alloy is added to the molten iron in the downward flow to be carried under the surface of the bath.

15. The method of claim 12 wherein the alloy also contains up to about 2.0% cerium and/or other rare earth elements by weight.

16. In the method of producing castings of ductile or compacted graphite cast irons, the improvement which comprises flowing a stream of molten iron containing carbon into a mold and adding to the stream of molten iron as it enters the mold a predominately iron alloy which contains as essential elements thereof from about 0.1 to about 10.0% silicon by weight, from about 0.9 to about 2.0% magnesium by weight and up to about 0.6% nickel by weight whereby the alloy is carried into the mold by the flowing stream of molten iron.

17. In the method of producing ductile or compacted graphite cast irons, the improvement comprising the steps of flowing a stream of molten iron containing carbon into a holding vessel, adding to said stream of molten iron a predominately iron alloy which contains from about 0.1 to about 10.0% silicon by weight, from about 0.9 to about 2.0% magnesium by weight and up to 0.6% nickel by weight whereby said alloy is carried by the stream of molten iron into the holding vessel and below the surface of the bath established therein.

18. In the method of producing castings of ductile and compacted graphite cast irons, the improvement which comprises supplying molten iron which contains carbon to at least one holding vessel, treating said molten iron by adding to the molten iron bath in the vessel a predominately iron alloy which contains as essential elements thereof from about 0.1 to about 10.0% silicon by weight, from about 0.5 to about 2.0% magnesium by weight and up to about 0.6% nickel by weight, moving a plurality of casting molds in sequence to bring one at a time into position below said vessel to receive treated molten iron from said vessel and adding more untreated molten iron containing carbon into said holding vessel along with more of said alloy in an iron casting operation.

19. The method of claim 18 wherein the plurality of molds are held stationary and the holding vessel is moved into position to supply treated molten iron to the molds.

20. The method of claim 18 wherein the holding vessel is held stationary and the plurality of molds are moved into position to receive treated molten iron from the holding vessel.

21. The method of claim 18 wherein the molten iron bath is agitated to circulate the molten iron downwardly in the middle of the bath and the alloy is added at the surface in the middle of the bath where it can be carried below the surface thereof by the downward flow of metal.

22. The method of claim 18 in which the alloy contains by weight from about 0.1 to about 10.0% silicon, about 0.5 to about 4.0% magnesium, and from about 0.1 to about 10.0% nickel as the essential ingredients in said predominately iron alloy and wherein the alloy has a density from about 6.5 to about 7.5 gms/cm$^3$.

23. The method of claim 22 wherein the alloy includes up to about 2.0% cerium and/or other rare earth elements by weight.

24. The method of claim 18 wherein there are a plurality of holding vessels for treating the molten iron with alloy and for supplying treated molten iron to the molds.

25. In the method of producing castings of ductile or compacted graphite cast irons, the improvement which comprises moving a plurality of holding vessels in a first circular path, moving a plurality of casting molds in a second circular path to bring the plurality of molds into position below said plurality of holding vessels to receive treated molten iron therefrom, establishing in said plurality of holding vessels a supply of molten iron containing carbon which has been treated with a predominately iron alloy containing as essential elements thereof by weight from about 3.0 to about 6.0% silicon, from about 0.9 to about 2.0% magnesium, and up to about 0.6% nickel by weight, interrupting the movement of said holding vessels and molds to hold them in stationary position while at least one mold receives treated molten iron from at least one holding vessel, and re-establishing the supply of treated molten iron in said holding vessels when held in stationary position as required for a casting operation.

26. The method of claim 25 wherein the iron alloy contains as essential elements by weight from about 0.1 to about 10.0% silicon, from about 0.5 to about 4.0% magnesium and from about 0.1 to about 10.0% nickel.

27. The method of claim 26 wherein said alloy includes up to about 2.0% cerium and/or other rare earth elements by weight.

28. The method of claim 25 wherein the untreated molten iron is supplied to said plurality of holding vessels and said alloy is added to the untreated molten iron to establish and re-establish said supply of treated molten iron in said plurality of vessels for transfer to said molds.

29. The method of claim 25 wherein the molten iron is treated with said alloy in one or more separate supply vessels which supply the treated molten iron to said plurality of holding vessels to establish and re-establish the supply of treated molten iron for transfer to said molds.

30. The method of claim 25 wherein additional alloy is added to the treated molten iron in said holding vessels to obtain a selected chemical composition of treated molten iron for transfer to the molds.

31. The method of claim 25 wherein untreated molten iron is partially treated with said alloy in one or more separate supply vessels which supply the partially treated molten iron to said plurality of holding vessels and additional alloy is added to said partially treated molten iron in said holding vessels to complete the treatment of the molten iron therein and establish and re-establish the supply of molten iron for transfer to said molds.

32. The method of claim 25 wherein the predominately iron alloy contains as essential elements by weight from about 3.0 to about 6% silicon, from about 0.9 to about 2.0% magnesium, up to about 0.6% nickel, up to about 2.0% cerium and/or other rare earth elements and 3.0 to 6.5% carbon.

33. The method of claim 25 wherein the density of said alloy is from about 6.5 to about 7.5 gms/cm$^3$.

34. The method of claim 25 wherein the plurality of holding vessels and plurality of casting molds are moved in selected intersecting paths that are not circular and treated molten iron is transferred from the vessels to the molds where the selected paths intersect.

35. The method of claim 34 wherein the selected paths are oblong and the treated molten iron is transferred to the molds while the holding vessels and molds are moving along a first straight portion of the oblong path where the paths of the holding vessels and molds intersect and wherein a separate supply container moving along a path that intersects a second straight portion of the oblong path of said holding vessels is employed for establishing and re-establishing the supply of treated molten iron for transfer to said molds.

36. The method of producing ductile or compacted graphite cast irons which comprises the step of introducing into molten iron that contains carbon an iron alloy comprising by weight from about 0.1 to about 10.0% silicon, from about 0.5 to about 4.0% magnesium, from about 0.1 to about 10.0% nickel and optionally from about 0.1 to about 2.0% of one or more rare earth elements with the balance of the alloy being iron to increase the magnesium content of said treated molten iron.

37. The method of claim 36 in which the one or more rare earth elements is predominately cerium.

38. The method of claim 36 in which the alloy is predominately iron having as essential elements from about 3.0 to about 6.0% silicon, up to about 0.6% nickel and about 0.9 to about 2.0% magnesium by weight of said iron alloy.

39. The method of claim 38 in which the density of the iron alloy is from about 6.5 to about 7.5 gms/cm$^3$.

40. The method of claim 36 in which the iron alloy is added to the molten iron in an amount sufficient to provide in the molten iron from about 0.015% to about 0.08% magnesium based on the weight of the treated molten iron.

41. An iron alloy for treating molten iron containing carbon to produce ductile cast iron containing nodular carbon, or compacted graphite cast iron, said iron alloy comprising by weight from about 0.1 to about 10.0% silicon, about 0.1 to about 10.0% nickel, about 0.5 to about 4.0% magnesium, and optionally up to about 2.0% of one or more rare earth elements, the balance of the alloy being iron.

42. An alloy for treating molten iron containing carbon to produce ductile cast iron containing nodular carbon or compacted graphite cast iron, said alloy being predominately iron having as essential elements by weight from about 3.0 to about 6.0% silicon, up to about 0.6% nickel, and about 0.9% to about 2.0% magnesium.

43. The alloy of claim 42 having density from about 6.5 to about 7.5 gms/cm$^3$.

44. The method of making an alloy for treating molten iron containing carbon to produce ductile or compacted graphite cast irons which comprises the steps of forming a molten iron bath comprising by weight from about 0.1 to about 10.0% silicon, about 0.1 to about 10.0% nickel, about 0.5 to about 4.0% magnesium, and optionally from about 0.1 to about 2.0% one or more rare earth elements, the balance being iron and maintaining said molten bath under superatmospheric pressure of an inert gas while reaction takes place and then rapidly solidifying the melt to form the iron alloy.

45. The method of making an alloy for treating molten iron containing carbon to produce ductile or compacted graphite cast irons which comprises the steps of forming a molten iron bath comprising by weight from about 3.0 to about 6.0% silicon, up to about 0.6% nickel, about 0.9 to about 2.0% magnesium, and optionally up to about 2.0% one or more rare earth elements, the balance being iron, maintaining said molten bath under from about 50 to about 75 p.s.i.g. pressure of an inert gas while reaction takes place and adjusting the proportions of said metals to produce the iron alloy with density from about 6.5 to about 7.5 gms/cm$^3$.

46. An iron alloy for treating molten iron containing carbon to produce ductile cast iron containing nodular carbon or compacted graphite cast iron, said alloy comprising by weight from about 0.1 to about 10.0% silicon, from 0.5 to about 4.0% magnesium, from about 0.1 to about 10.0% nickel, from about 0.1 to about 2.0% cerium and from about 0.5 to about 6.5% carbon, the balance of the alloy being iron.

* * * * *